US005376998A

United States Patent [19]

Suzuki

[11] Patent Number: 5,376,998

[45] Date of Patent: Dec. 27, 1994

[54] IMAGE FORMATION APPARATUS INCLUDING A PLURALITY OF DEVELOPMENT UNIT SELECTIVELY DRIVEN BY A COMMON POWER SOURCE

[75] Inventor: Koji Suzuki, Yokohama, Japan

[73] Assignee: Canon Kabushiki Kaisha, Tokyo, Japan

[21] Appl. No.: 964,095

[22] Filed: Oct. 21, 1992

[30] Foreign Application Priority Data

Oct. 24, 1991 [JP] Japan ..... 3-277601

[51] Int. Cl.[5] ..... G03G 15/01

[52] U.S. Cl. ..... 355/326; 355/246

[58] Field of Search ..... 355/208, 246, 326, 327; 118/645

[56] References Cited

U.S. PATENT DOCUMENTS

| | | | |
|---|---|---|---|
| 4,600,294 | 7/1986 | Suzuki et al. | 355/246 |
| 4,600,295 | 7/1986 | Suzuki | 355/246 |
| 4,641,200 | 2/1987 | Shoji et al. | 355/246 |
| 4,841,335 | 6/1989 | Kohyama | 355/326 X |
| 4,942,429 | 7/1990 | Kakitani | 355/208 |
| 4,947,212 | 8/1990 | Ikegawa et al. | 355/326 X |

FOREIGN PATENT DOCUMENTS

| | | | |
|---|---|---|---|
| 0150271 | 7/1987 | Japan | 355/327 |
| 0097967 | 4/1988 | Japan | 355/326 |
| 0249162 | 10/1988 | Japan | 355/326 |
| 0093758 | 4/1989 | Japan | 355/326 |
| 0043372 | 2/1992 | Japan | 355/326 |
| 0066970 | 3/1992 | Japan | 355/327 |

*Primary Examiner*—R. L. Moses
*Assistant Examiner*—William J. Royer
*Attorney, Agent, or Firm*—Fitzpatrick, Cella, Harper & Scinto

[57] ABSTRACT

An image formation apparatus such as a color copier or color printer comprises a plurality of development units, a development bias power source to supply power sources to the development units, a switch for allowing the output power of the development bias power source to be supplied to the development unit selected in accordance with a sequence control signal for image formation generated from a sequence controller, and a power supply control circuit to selectively to supply the output power of the development bias power source to the development unit which is developing only for a development period of time of each development unit. The development units are fixedly arranged near the photosensitive drum on which an electrostatic latent image is formed. The development bias power source includes both an AC component and a DC component. Since the amplitude, frequency, DC potential, and the like of the development bias power source are switched for each development unit selected, it is sufficient to use only one expensive power source. In this manner, image deterioration by the mechanical vibration due to the movement of the development unit can be eliminated.

17 Claims, 8 Drawing Sheets

IMAGE FORMATION APPARATUS INCLUDING A PLURALITY OF DEVELOPMENT UNIT SELECTIVELY DRIVEN BY A COMMON POWER SOURCE

BACKGROUND OF THE INVENTION

1. Field of the Invention

The invention relates to an image formation apparatus and, more particularly, to an image formation apparatus having a plurality of development units.

2. Related Background Art

In conventional color copying apparatus and color printers, development units are moved by a rotating or elevating method and only the development unit which is being used to develop an electrostatic latent image is closely adhered to a photo sensitive material.

Therefore, a development bias power source is held in a connecting state with all of the development units. However, after that, development units of a fixed type have been devised in order to realize a high copying speed and a high image quality.

According to the conventional apparatuses, it is very difficult to move the development units which occupy considerable volume and weight in the copying apparatus at a high speed without generating a vibration which causes of deterioration of the image.

According to the rotating method and elevating method, there are problems in that not only is a construction of the development units complicated but also a space of the whole development units is large.

When the fixed type is used, since all of the development units face the photo sensitive drum, it is necessary to control at a high speed the AC component and DC component of a development bias which is applied to a development sleeve so that the toners of the development units which are not being used for development are not adhered to the photo sensitive material. It is necessary to provide a development bias power source for each development unit.

Since the development bias power source is constructed by multiplexing a DC high voltage to an AC voltage, an AC high voltage transformer, a DC high voltage transformer, their control circuits, and the like are fairly expensive. There is a problem in that a construction including a number of power sources equal to the number of development units provided results remarkably raises the cost of the apparatus.

SUMMARY OF THE INVENTION

It is an object of the invention to provide an image formation apparatus which can solve the problems mentioned above.

Another object of the invention is to provide an image formation apparatus in which there is no need to provide a number of expensive development bias power sources equal to the number development units, and wherein it is sufficient to use only one power source.

Still another object of the invention is to provide an image formation apparatus in which the attachment and detachment of development units is eliminated, image forming speed is raised, and deterioration of an image due to a mechanical vibration in association with the movement of the development units can be perfectly eliminated.

Yet another object of the invention is to provide an image formation apparatus in which a pulse transformer is driven at a high frequency, the pulse transformer is miniaturized, and an electronic switch can be switched at a high speed.

In one aspect, the present invention provides an image formation apparatus including a plurality of development units; a development bias power source to supply power sources to the development units; switching means for supplying an output power of the development bias power source to the development unit selected in accordance with a sequence control signal to form an image; and power supply control means for controlling so as to supply the output power from the development bias power source to the development unit during the development for only a development period of time of each development unit.

In another aspect, the present invention provides an image forming apparatus including a plurality of development units; a development bias power source to supply power sources to the development units; switching means for supplying an output power from the development bias power source to the development unit selected in accordance with a sequence control signal to form an image; and switching means for switching an amplitude, a frequency, a DC potential, and the like of the output power from the development bias power source for each development unit selected.

According to one aspect of the invention, the switching means includes a bridge rectifying circuit constructed by high withstanding voltage diodes; a high voltage withstanding transistor connected to a DC output section of the bridge rectifying circuit; a pulse transformer to drive a base of the transistor; and a primary side drive circuit of the pulse transformer.

According to the invention, the power sources are supplied from the development bias power source to the development units, the output power from the development bias power source is supplied to the development unit selected by the switching means in accordance with the sequence control signal for image formation. The power supply control means controls so as to supply the output power from the development bias power source to the development unit which is developing for only a development period of time of each development unit.

According to another aspect of the invention, power sources are supplied from the development bias power source to the development units, the output power from the development bias power source is supplied by the electronic switching circuit to the development unit selected in accordance with the sequence control signal for image formation. The amplitude, frequency, DC potential, and the like of the output power of the development bias power source are switched by the switching means for each development unit selected.

The above and other objects and features of the present invention will become apparent from the following detailed description and the appended claims with reference to the accompanying drawings.

DETAILED DESCRIPTION OF THE PREFERRED EMBODIMENTS

Figure 7:
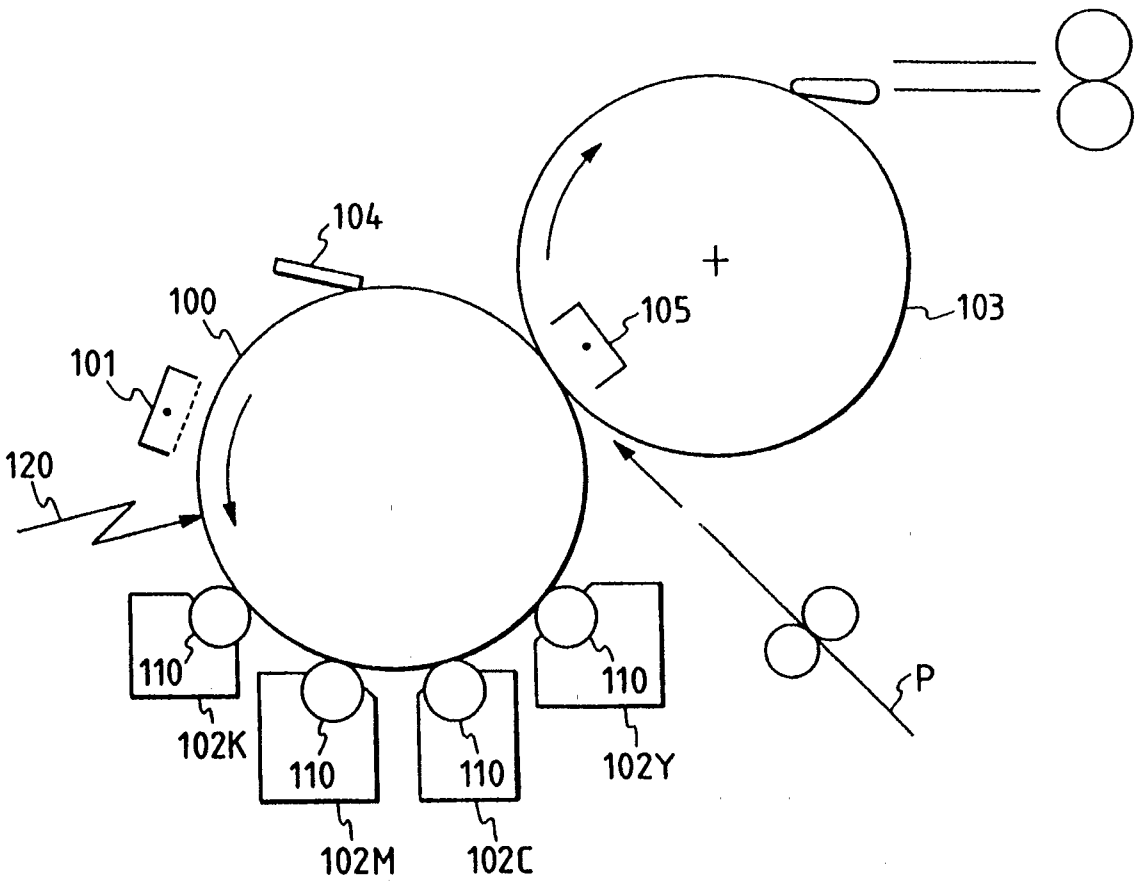
FIG. 7 is a cross sectional view of a main section of a color image forming apparatus which can embody the invention.

FIG. 7 shows an image formation apparatus in which a plurality of development units are arranged around a photo sensitive drum, which acts as an image supporting material to which the invention can be applied, and a multi-color image can be formed. FIG. 7 shows a state in which a primary charging unit 101, four development units 102, a copy transfer drum 103, and a cleaning unit 104 are arranged around a photo sensitive drum 100. The development units include a black development unit 102K having a black toner, a magenta development unit 102M having a magenta toner, a cyan development unit 102C having a cyan toner, and a yellow development unit 102Y having a yellow toner. In the diagram, reference numeral 105 denotes a transfer charging unit and 120 indicates an image light for exposure such as a laser beam or the like. A recording paper P is wound around the surface of the transfer drum 103 and color images on the photosensitive drum 100 are sequentially transferred onto the recording paper P.

A magnetic toner of one component type is generally used in the black development unit 102K. A developing agent of two components comprising a magnetic carrier and a non-magnetic toner is used in each of the magenta, cyan, and yellow development units 102M, 102C, and 102Y. This is because, since the magnetic toner uses black magnetite as a magnetic material, it is improper as a toner which needs magenta, cyan, or yellow color. The non-magnetic toner is used as a magenta, cyan, or yellow toner. The non-magnetic toner is mixed at the magnetic carrier and is used in the developing work.

Since each development unit is of the fixed type, the image is not deteriorated by vibration due to the movement of the development unit.

Figure 1:
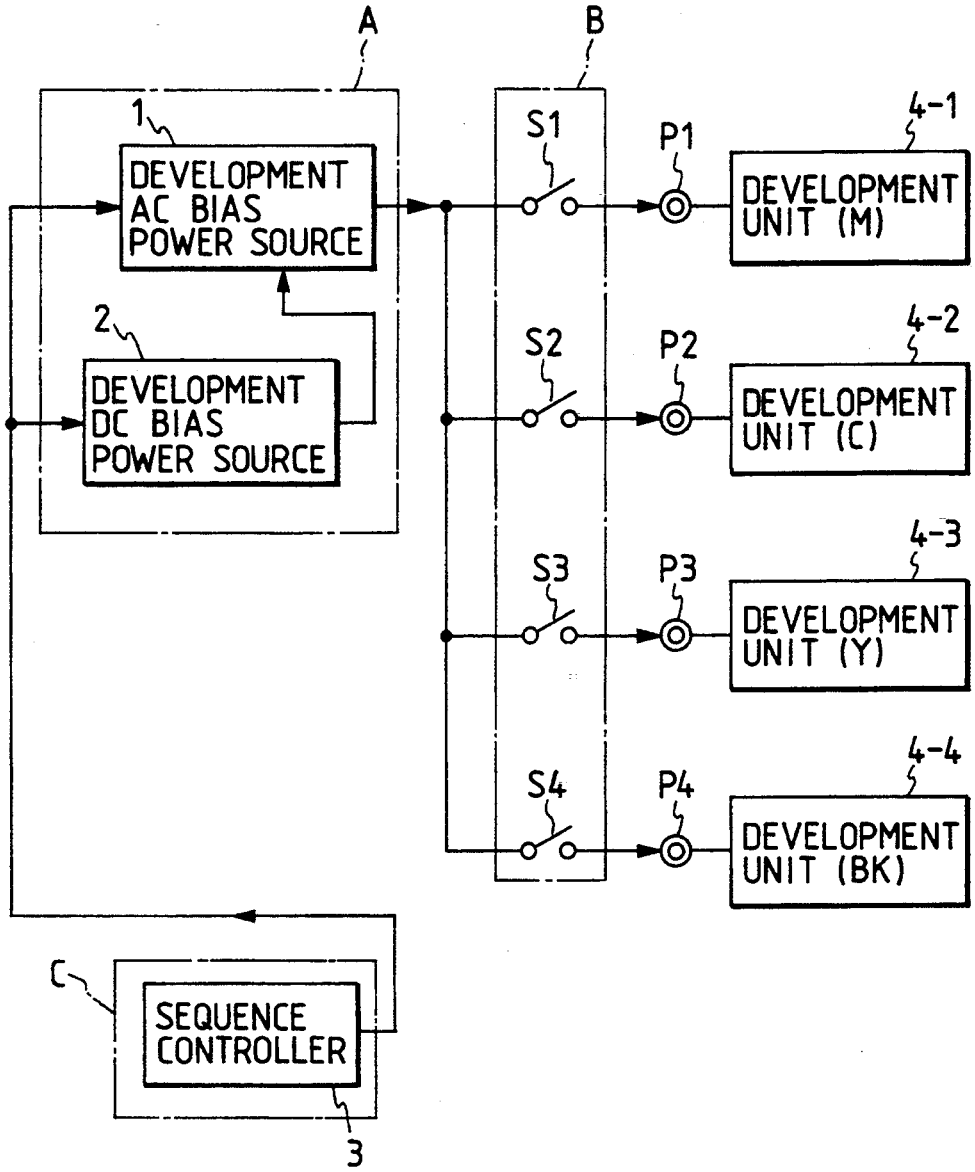
FIG. 1 is a schematic view of an image formation apparatus according to a first embodiment of the invention.

In FIG. 1, A denotes a development bias power source comprising a development AC bias power source 1 and a development DC bias power source 2. The development bias power source A is means for supplying a power source to each of a plurality of development units 4-1, 4-2, 4-3, and 4-4.

B denotes an electronic switching circuit which comprises electronic switches $S_1$ to $S_4$ and allows an output power from the development bias power source A to be supplied to the development unit selected in accordance with a sequence control signal for image formation as will be explained in detail hereinafter.

C denotes power supply control means which includes a sequence controller 3 to sequence control various apparatuses in the image formation apparatus main body and is means for controlling so as to supply the output power from the development bias power source A to the development unit which is developing for only a developing period of time of each of the development units 4-1 to 4-4 as will be explained in detail hereinafter. That is, by sequentially turning on the switches $S_1$ to $S_4$ in accordance with this order, the development bias voltage is applied to only the development unit which is at present used to develop.

In FIG. 1, the sequence controller 3 generates control signals of an output timing, DC level, and the like. The development units 4-1 to 4-4 are respectively connected through output terminals $P_1$ to $P_4$ and electronic switches $S_1$ to $S_4$ to the development AC bias power source 1.

A circuit of the first embodiment will now be described with reference to FIG. 2.

Figure 2:
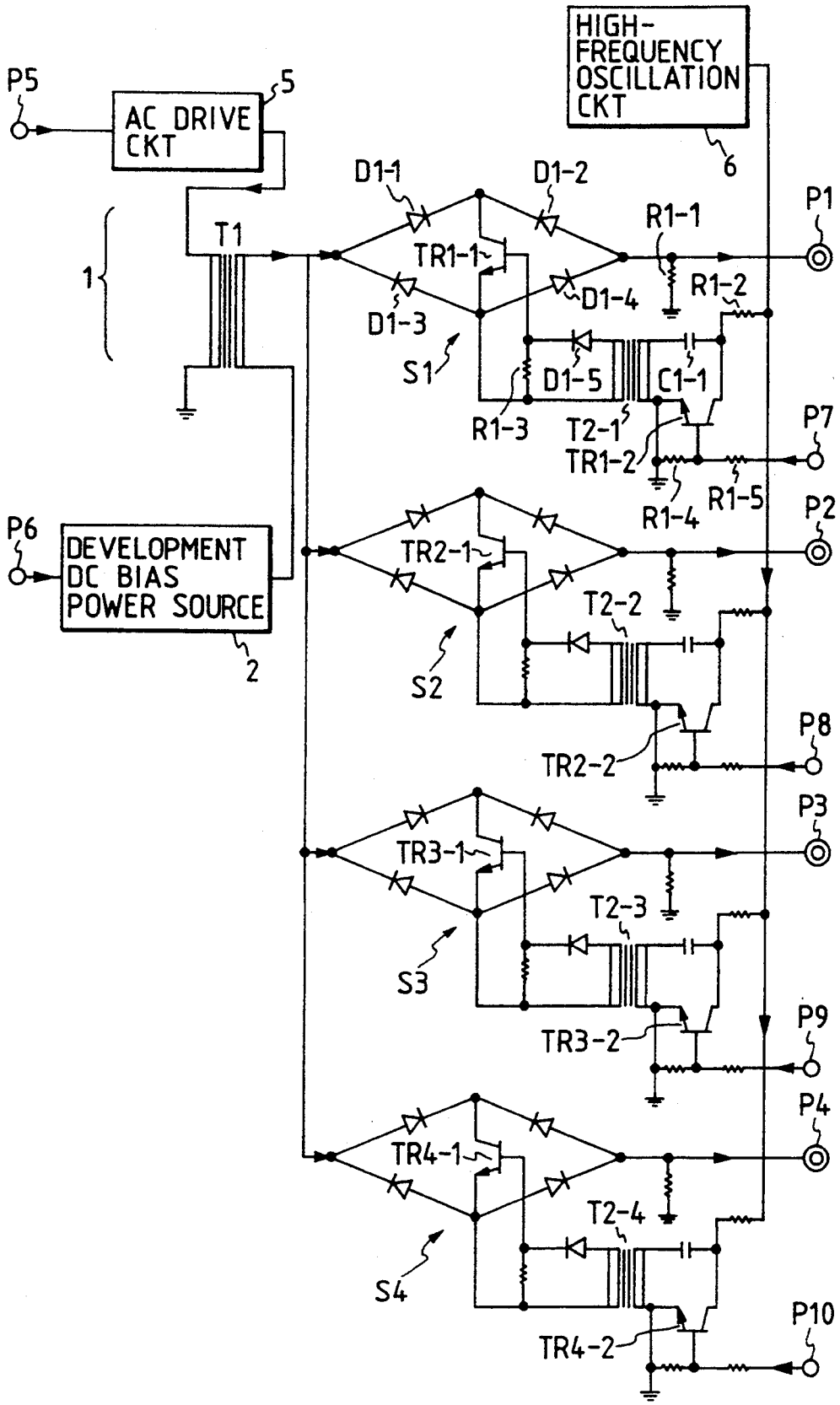
FIG. 2 is a detailed circuit diagram of the first embodiment.

FIG. 2 shows a detailed circuit according to the first embodiment.

In FIG. 2, the development AC bias power source 1 comprises a step-up transformer $T_1$ and its AC drive circuit 5. An output of the development DC bias power source 2 is connected to one end of a secondary side winding of the transformer $T_1$. A timing signal to turn on/off the output is connected from the sequence controller 3 to an input terminal $P_5$ of the drive circuit 5. A control signal of the DC output is connected from the sequence controller 3 to an input terminal $P_6$ of the DC bias power source 2, thereby performing the control of the DC level including the on/off control of the DC output.

The electronic switches $S_1$ to $S_4$ are constructed as follows.

A bridge rectifying circuit is formed by high voltage withstanding diodes $D_1$-1 to $D_1$-4.

A collector and an emitter of a high voltage withstanding transistor $TR_1$-1 are connected to a rectifying output section of the bridge rectifying circuit.

The secondary side output of the step-up transformer $T_1$ is connected to one end of an AC input section of the bridge rectifying circuit. A development unit connecting terminal $P_1$ is connected to the other end.

A base and the emitter of the transistor $TR_1$-1 are insulated from ground by a pulse transformer $T_2$-1. One end on the primary side of the pulse transformer $T_2$-1 is connected to ground and the other end is connected to an output of a high-frequency oscillation circuit 6 through a capacitor $C_1$-1 and a resistor $R_1$-2.

A transistor $TR_1$-2 is connected between a node of the capacitor $C_1$-1 and the resistor $R_1$-2 and ground.

A development unit selection signal is supplied from the sequence controller to the terminal $P_7$.

While the development unit connected to the terminal $P_1$ is not developing, the potential of the terminal $P_7$ is held to the high level, so that the transistor $TR_1$-2 is made conductive.

When the transistor $TR_1$-2 is made conductive as mentioned above, an output signal of the high-frequency oscillation circuit 6 is not supplied to the pulse transformer $T_2$-1, so that the high voltage withstanding transistor $TR_1$-1 is shut off. All of the diodes $D_1$-1 to $D_1$-4 of the bridge rectifying circuit are shut off. The development bias power source output and the terminal $P_1$ are completely disconnected.

When the development unit connected to the terminal $P_1$ is set into the developing state, the potential of the terminal $P_7$ is held to the low level and the transistor $TR_1$-2 is shut off.

When $TR_1$-2 is shut off, the output signal of the oscillation circuit 6 is supplied to the primary side of the pulse transformer $T_2$-1. The transistor $TR_1$-1 is made conductive. All of the diodes $D_1$-1 to $D_1$-4 of the bridge circuit are made conductive. The development bias power source output and the terminal $P_1$ are completely connected.

The oscillation circuit 6 generates a high frequency output which is at least ten or more times as high as a development AC bias frequency.

A high resistance ($R_1$-1) of about 100 kΩ or more is connected between the output terminal $P_1$ and ground, thereby holding a sleeve voltage of the development unit which is not developing to the ground level.

Figure 3A:
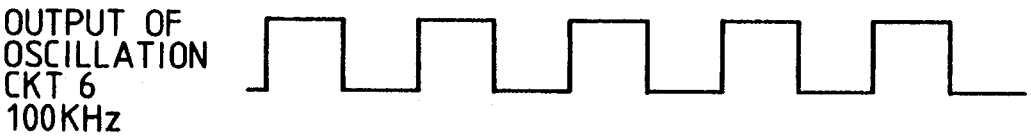
FIGS. 3A and 3B are operation timing charts of an electronic switch in the first embodiment.
Figure 3B:
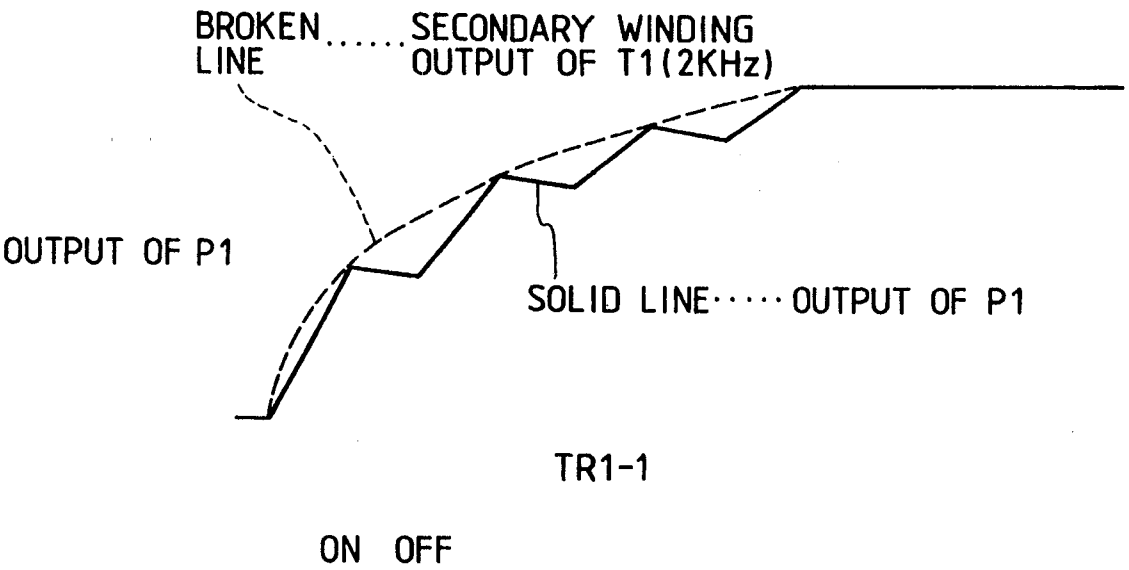

FIGS. 3A and 3B are timing charts showing a state of the operation of the electronic switch.

FIG. 3A shows an output of the high-frequency oscillation circuit 6 (FIG. 2). FIG. 3B shows an output of the terminal $P_1$.

A frequency of development bias AC is selected to a value within a range from 1 to 2 kHz. An oscillating frequency of the oscillation circuit 6 to drive the pulse transformer is set to about 100 kHz. When the transistor $TR_1$-2 is turned off, the high withstanding voltage transistor $TR_1$-1 is repetitively turned on/off at a period of the output of the oscillation circuit 6. A load capacitance is charged up to an output potential of the secondary winding of the step-up transformer $T_1$ at the timing of turn-on of the transistor $TR_1$-1. When the transistor $TR_1$-1 is turned off, a value of a bleeder resistor $R_1$-1 of the output is selected to be a large value as compared with an ON resistance value of the bridge circuit. Therefore, a level drop by a slight discharge merely occurs.

A second embodiment of the invention will now be described with reference to FIGS. 4A to 4D.

FIGS. 4A to 4D are operation timing charts in the second embodiment of the invention.

Since a construction of the second embodiment is similar to that of the first embodiment, its description is omitted here.

Figures 4A, 4B, 4C, 4D:
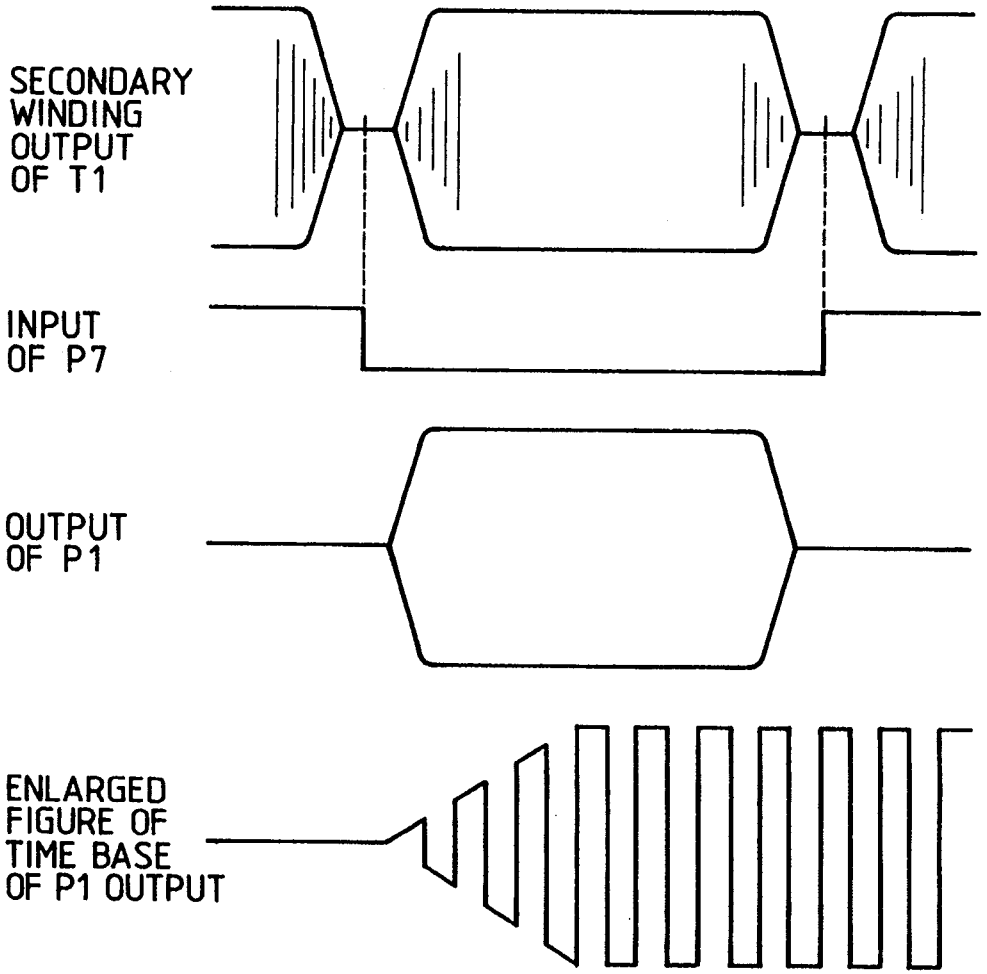
FIGS. 4A to 4D are operation timing charts in a second embodiment of the invention.

FIG. 4A is an enlarged diagram of the output of the secondary winding of the step-up transformer $T_1$. FIG. 4B is an enlarged diagram of the input to the terminal $P_7$. FIG. 4C is an enlarged diagram of the output of the terminal $P_1$. FIG. 4D is an enlarged diagram of the time base of the output of the terminal $P_1$.

According to the second embodiment, the AC output and DC output of the development bias are set to 0 before a predetermined switching timing of the switch. After the elapse of the predetermined timing after completion of the switching, the AC output and DC output are returned to a predetermined development level.

A soft start function of the development bias power source can be effected as mentioned above. An overshoot at the switching timing can be suppressed.

A third embodiment of the invention will now be described with reference to FIG. 5.

Figure 5:
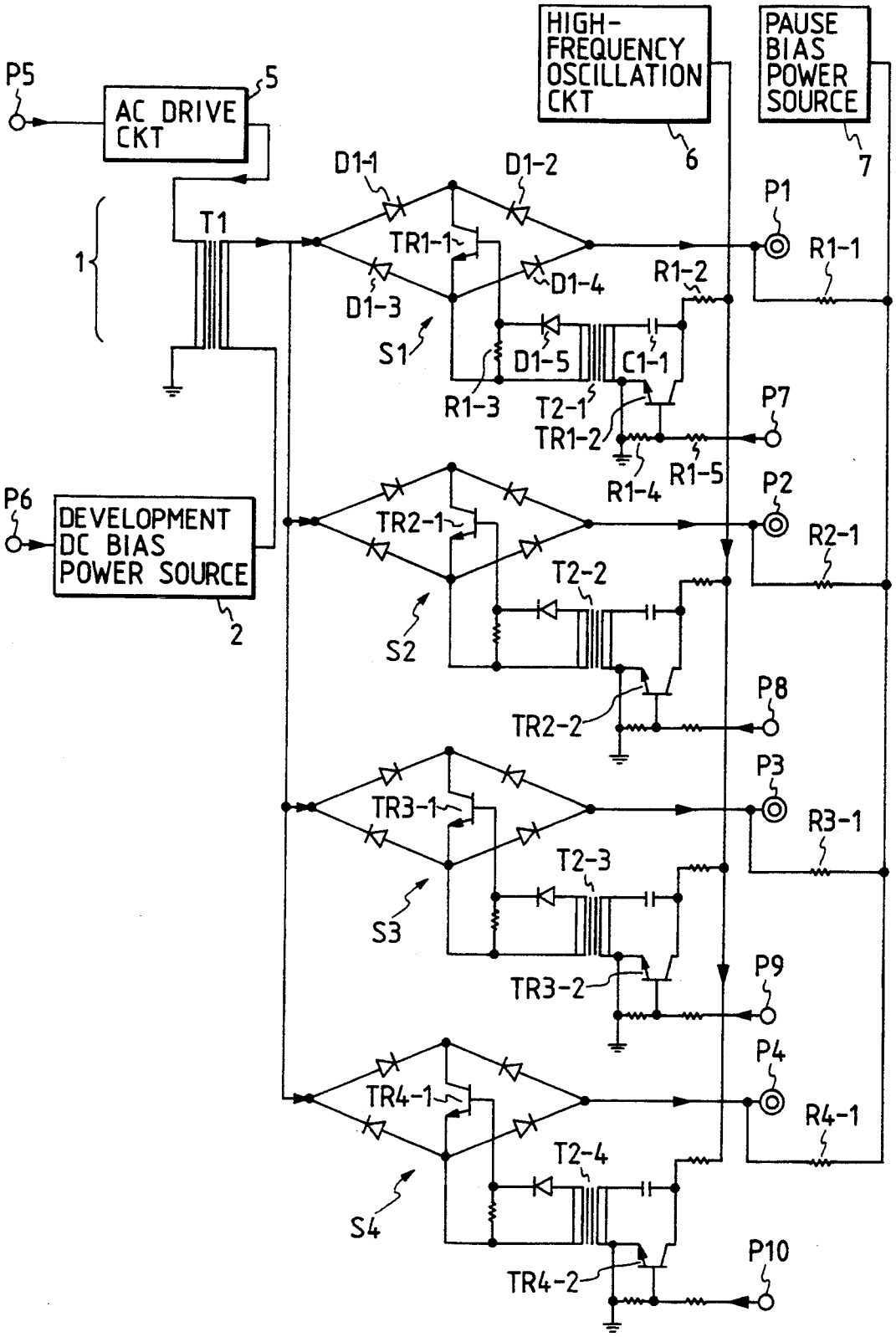
FIG. 5 is a detailed circuit diagram of a third embodiment of the invention.

FIG. 5 is a detailed electric circuit diagram of the third embodiment of the invention.

According to the third embodiment, a predetermined DC high voltage can be applied to the sleeve of the development unit which is in a pause state as shown in FIG. 5.

In FIG. 5, a pause bias power source 7 generates a predetermined DC high voltage so that the toner doesn't move from the pause development unit to the photo sensitive drum 100.

The output level is selected to be a value near the maximum latent image potential in the case of a photosensitive material of a positive polarity and a toner of a negative polarity.

A fourth embodiment of the invention will now be described with reference to FIG. 6.

Figure 6:
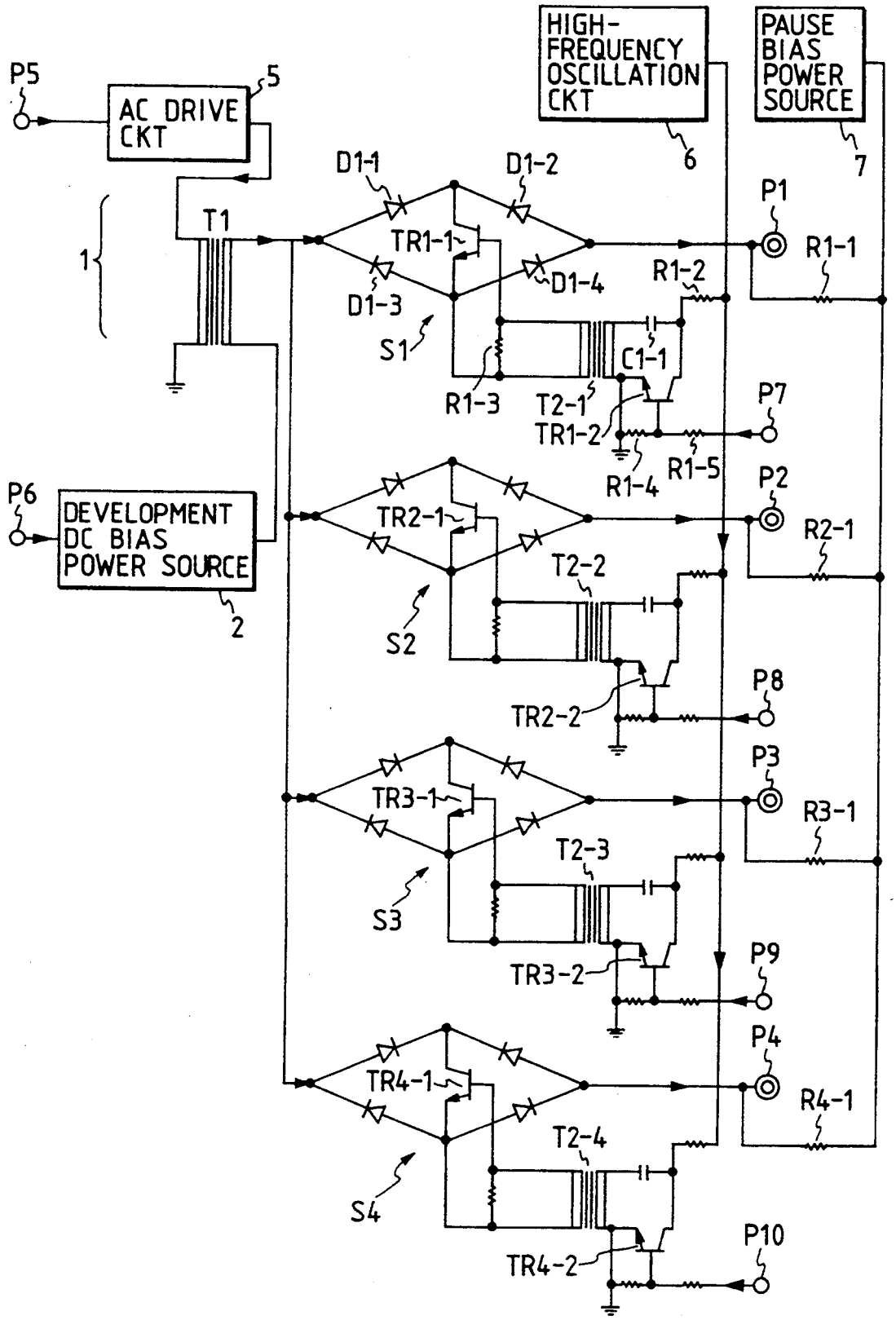
FIG. 6 is a detailed circuit diagram of a fourth embodiment of the invention.

FIG. 6 is a detailed electric circuit diagram of the fourth embodiment of the invention.

In FIG. 6, in order to improve a switching speed of a high voltage withstanding transistor TR-1, a rectifying diode on the secondary side of the pulse transformer $T_2$-1 is eliminated and the secondary winding of the transformer is directly connected to a base and an emitter.

Figure 8:
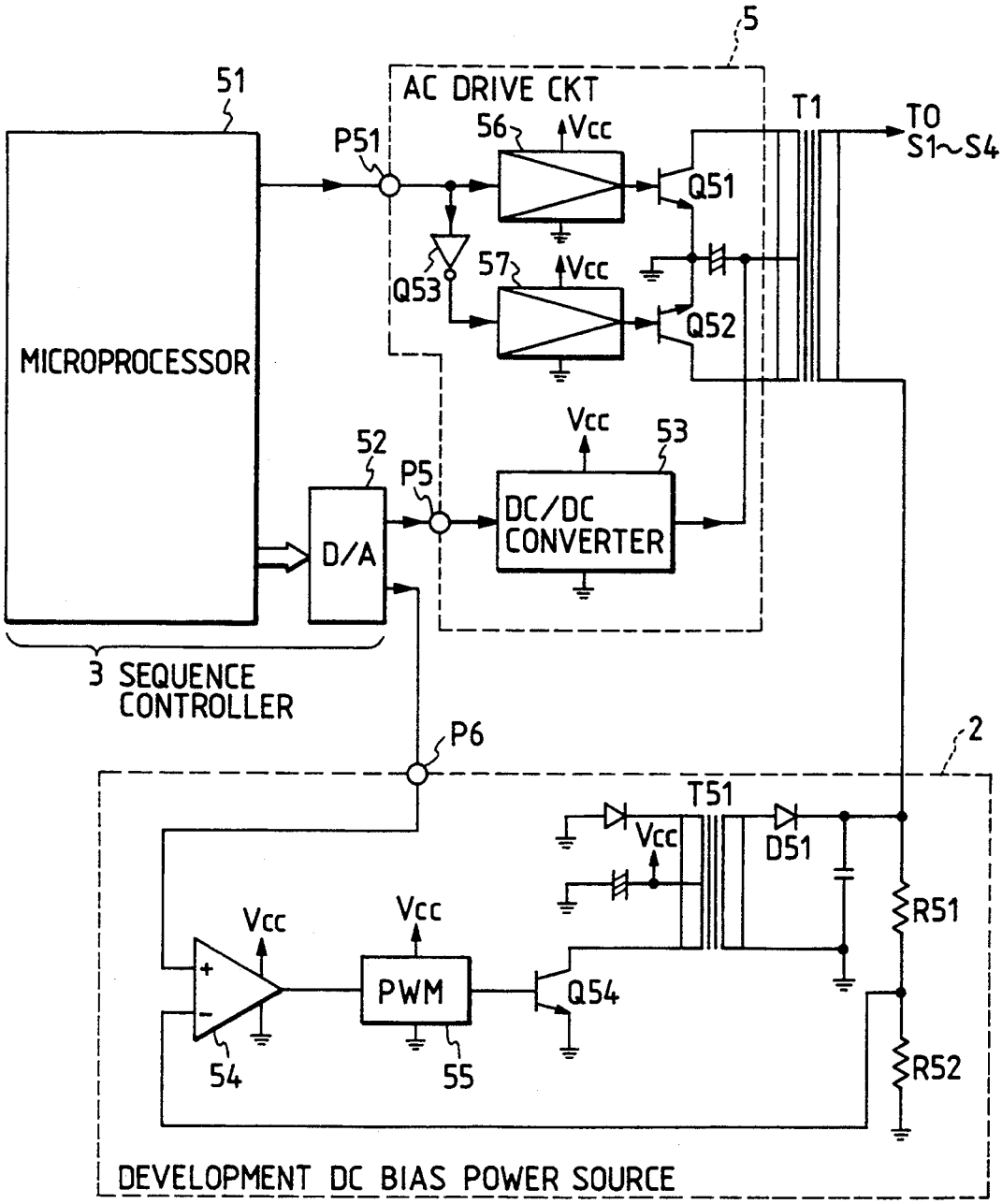
FIG. 8 is a detailed circuit diagram of a fifth embodiment of the invention.

FIG. 8 shows a fifth embodiment of the invention.

A microprocessor 51 and a D/A converter 52 are included in the sequence controller 3.

An output of a programmable frequency counter in the microprocessor 51 is supplied to the AC drive circuit 5 through a terminal $P_{51}$.

This counter output is supplied to switching transistors $Q_{51}$ and $Q_{52}$ to drive the primary side of the transformer $T_1$ through an inverter $Q_{53}$ and base drive circuits 56 and 57, thereby driving them. An output voltage of a DC/DC converter 53 is supplied to an intermediate tap of the primary winding of the transformer $T_1$.

A digital value which is controlled in accordance with an internal program of the microprocessor is converted into an analog signal by the D/A converter 52 and this analog voltage is applied to an input terminal of the DC/DC converter 53 through the terminal $P_5$.

The voltage of a large power which is proportional to the input voltage of the DC/DC converter 53 is generated from the converter 53. The AC high voltage having an amplitude proportional to the output of the converter 53 and the signal frequency applied to the terminal $P_{51}$ is obviously obtained from the secondary high voltage winding of the AC high voltage transformer $T_1$.

A control value of the development DC bias is controlled in dependence on the internal program of the microprocessor 51.

The control value is converted into the analog value by the D/A converter 52. The analog value is supplied to a non-inverting input terminal of a differential amplifier 54 through the terminal $P_6$. The differential amplifier 54 compares the control value and the detection value of the development DC power output and supplies the result of the comparison to a PWM circuit 55.

Synchronously with the switching of the switches $S_1$ to $S_4$, the amplitude and frequency of the AC bias component and the output value of the DC bias power source are switched.

That is, since the development characteristics of the development unit of each color differ for each color, the optimum AC amplitude and frequency and DC bias value are selected in accordance with those characteristics. Consequently, the development according to the development characteristics of each color can be performed even when one power source is used for a plurality of development units.

For each of the first to fifth embodiments described above, image formation apparatuses in the following items (a) to (d) are also incorporated in the scope of the invention.

(a) Image formation apparatus using a high voltage withstanding FET or another high voltage withstanding switching device in place of a high voltage withstanding transistor.

(b) Image formation apparatus in which drive pulses of a frequency which is sufficiently higher than the frequency of the development AC bias are supplied to the primary side of the pulse transformer to drive the base of the high voltage withstanding transistor for only the development period of time of the development unit connected.

(c) Image formation apparatus in which a resistor of about 1 to 100 mΩ is inserted between the connecting position of the electronic switch and the development unit and ground.

(d) Image formation apparatus in which each of the AC output and DC output of the development bias power source output are controlled to 0 at the timing when the electronic switch switches the development bias power output to the next development unit.

As described above, there is no need to provide number of expensive development bias power sources equal to the number of development units. It is sufficient to use only one power source. The mechanical detachment and attachment of the development unit can be eliminated. Thus, the image forming speed can be raised. The deterioration of the image by the mechanical oscillation in association with the movement of the development unit can be perfectly eliminated. By driving the pulse transformer at a high frequency, the pulse transformer can be miniaturized and the switching operation of the electronic switch can be performed at a high speed.

Although the invention is suitable for a development unit of the fixed type, the invention is not limited to such a type but also can be applied to a type in which the development unit is switched by the rotating method or elevating method.

Although the development bias in which both of the AC and DC outputs are multiplexed has been used in the above embodiments, the invention also can be applied to the case of using only the DC bias or AC bias.

The present invention is not limited to the foregoing embodiments but many modifications and variations are possible within the spirit and scope of the appended claims of the invention.

What is claimed is:

1. An image formation apparatus comprising:

a plurality of development units;

a common development bias power source for supplying an output power to the development units;

sequence signal control means for supplying a sequence control signal for image formation;

switching means for selectively applying an output power of said common development bias power source to a development unit selected in accordance with the sequence control signal for image formation;

power supply control means for controlling said common development power source so that the output power of the common development bias power source is selectively applied to the selected development unit for a respective development period for each development unit; and characteristic changing means for changing a characteristic of the output power of the common development power source in accordance with the selected development unit.

2. An apparatus according to claim 1, wherein said switching means comprises:

a bridge rectifying circuit including high voltage withstanding diodes;

a high voltage withstanding switching device connected to a DC output section of said rectifying circuit;

a pulse transformer for driving a base of said switching device; and a primary side drive circuit of the pulse transformer.

3. An apparatus according to claim 1, further comprising:

a photosensitive material on which an electrostatic latent image is formed, and wherein said plurality of development units are fixedly arranged.

4. An apparatus according to claim 1, wherein said development bias power source includes a DC component and an AC component.

5. An image formation apparatus comprising:

a plurality of development units;

a common development bias power source for supplying an output power to the development units;

sequence signal control means for supplying a sequence control signal for image formation;

first switching means for selectively applying an output power of the common development bias power source to a development unit selected in accordance with the sequence control signal for image formation; and second switching means for switching a characteristic of the output power of the common development bias power source in accordance with a selected development unit.

6. An apparatus according to claim 5, wherein said first switching means comprises:

a bridge rectifying circuit including high voltage withstanding diodes;

a high voltage withstanding transistor connected to a DC output section of the rectifying circuit;

a pulse transformer for driving a base of said transistor; and a primary side drive circuit of the pulse transformer.

7. An apparatus according to claim 5, further comprising:

a photosensitive material on which an electrostatic latent image is formed, and wherein said plurality of development units are fixedly arranged.

8. An apparatus according to claim 5, wherein said development bias power source includes a DC component and an AC component.

9. An apparatus according to claim 8, wherein said second switching means switches an output voltage of the DC component of the output power in accordance with the selected development unit.

10. An apparatus according to claim 5, wherein said second switching means switches an amplitude of the output power in accordance with the selected development unit.

11. An apparatus according to claim 5, wherein said development bias power source includes an AC component.

12. An apparatus according to claim 11, wherein said second switching means switches a frequency of the output power in accordance with the selected development unit.

13. An apparatus according to claim 11, wherein said second switching means switches an amplitude of the AC component of the output power in accordance with the selected development unit.

14. An image formation apparatus comprising:

a plurality of development units;

a common development bias power source for supplying an output power to the development units;

sequence signal control means for supplying a sequence control signal for image formation;

switching means for selectively applying an output power of said common development bias power source to a development unit selected in accordance with the sequence control signal for image formation; and power supply control means for controlling the common development bias power source so that the output power of the common development bias power source is applied to the selected development unit for a respective development period for each development unit;

wherein said common development bias power source includes a common feedback controller for controlling the output power of said power source.

15. An apparatus according to claim 14, further comprising characteristic changing means for changing a characteristic of the output power of said power source in accordance with the selected development unit.

16. An image formation apparatus comprising:

a plurality of development units;

a common development bias power source for supplying an output power to the development units;

switching means for selectively applying an output power of said common development bias power source to a development unit selected in accordance with a sequence control signal for image formation, said switching means comprising a bridge rectifying circuit including high voltage withstanding diodes, a high voltage withstanding switching device connected to a DC output section of said rectifying circuit, a pulse transformer for driving a base of said switching device, and a primary side drive circuit of the pulse transformer; and power supply control means for controlling said common development bias power source so that the output power of the common development bias power source is selectively applied to the selected development unit for a respective development period for each development unit.

17. An image formation apparatus comprising:

a plurality of development units;

a common development bias power source for supplying an output power to the development units;

first switching means for selectively applying an output power of the common development bias power source to a development unit selected in accordance with a sequence control signal for image formation; and second switching means for switching a characteristic of the output power of the common development bias power source in accordance with the selected development unit;

wherein said first switching means comprises a bridge rectifying circuit including high voltage withstanding diodes, a high voltage withstanding transistor connected to a DC output section of the rectifying circuit, a pulse transformer for driving a base of said transistor, and a primary side drive circuit of the pulse transformer.

* * * * *

UNITED STATES PATENT AND TRADEMARK OFFICE

CERTIFICATE OF CORRECTION

PATENT NO. : 5,376,998

DATED : December 27, 1994

INVENTOR(S) : KOJI SUZUKI

It is certified that error appears in the above-indentified patent and that said Letters Patent is hereby corrected as shown below:

On the Title page, item [54], Title:

"UNIT" should read --UNITS--.

Column 1

Line 3, "UNIT" should read --UNITS--.
Line 60, "the" should be deleted.

Signed and Sealed this

Second Day of May, 1995

*Attest:*

*Attesting Officer*

BRUCE LEHMAN

*Commissioner of Patents and Trademarks*